US007357686B2

(12) United States Patent
Lin et al.

(10) Patent No.: US 7,357,686 B2
(45) Date of Patent: Apr. 15, 2008

(54) BOAT PROPELLER WITH ADJUSTABLE BLADES FOR ADJUSTING THE PITCH THEREOF

(76) Inventors: Huei-Jeng Lin, No. 13, Aly. 107, Lane 155 Sec. 3, Chilong Rd., Da-an Dist., Taipei City (TW); Chin-I Liao, No. 2, Aly. 1, Lane 100, Choushan Rd., Da-an Dist., Taipei City (TW); Yan-Min Guo, 8F-15, No. 58, Shouha Rd., Gangshan Dist., Kao-Hsiung Hsien (TW)

( * ) Notice: Subject to any disclaimer, the term of this patent is extended or adjusted under 35 U.S.C. 154(b) by 528 days.

(21) Appl. No.: 11/160,414

(22) Filed: Jun. 22, 2005

(65) Prior Publication Data

US 2006/0292007 A1 Dec. 28, 2006

(51) Int. Cl.
*B63H 3/00* (2006.01)

(52) U.S. Cl. ..... 440/50; 416/153; 416/244 B; 416/220 R

(58) Field of Classification Search ..... 440/50; 416/153, 244 B, 220 R
See application file for complete search history.

(56) References Cited

U.S. PATENT DOCUMENTS

| | | | | |
|---|---|---|---|---|
| 2,850,106 | A * | 9/1958 | Swan | 416/2 |
| 5,326,223 | A * | 7/1994 | Speer | 416/46 |
| 6,364,610 | B1 * | 4/2002 | Muller | 416/153 |
| 6,506,019 | B2 | 1/2003 | Lin et al. | |
| 6,896,564 | B2 * | 5/2005 | Willmot | 440/50 |
| 2003/0021691 | A1 * | 1/2003 | Powers | 416/244 B |
| 2006/0188375 | A1 * | 8/2006 | Bussieres et al. | 416/220 R |

* cited by examiner

*Primary Examiner*—Stephen Avila
(74) *Attorney, Agent, or Firm*—Winston Hsu

(57) ABSTRACT

A boat propeller comprises a hub formed of a first cylindrical member and a second cylindrical member detachably joined together. The second cylindrical member comprises a plurality of insertion cavities formed in the second cylindrical member, an end of each of the insertion cavities having a plurality of receptacle members. The boat propeller also comprises a plurality of blades equal in number to the number of insertion cavities. Each blade comprises a blade piece portion and an adjustment member, a tip of the adjustment member comprising a positioning member such that the positioning member makes contact with at least one of the receptacle members when the adjustment member is inserted into the corresponding insertion cavity. The positioning member of the adjustment member is selectively matched with one or more of the receptacle members for adjusting a pitch of the blades.

7 Claims, 11 Drawing Sheets

BOAT PROPELLER WITH ADJUSTABLE BLADES FOR ADJUSTING THE PITCH THEREOF

BACKGROUND OF THE INVENTION

1. Field of the Invention

The present invention relates to a boat propeller, and more specifically, to a boat propeller which can be easily adjusted for changing the pitch of the propeller during assembly of the boat propeller. Each blade of the boat propeller has an adjustment member connected to the blade with a reinforced connection, the adjustment member used for changing the pitch of the blade.

2. Description of the Prior Art

Propeller pitch refers to an angle formed between a blade chord line in any radial position and a plane of rotation. In other words, propeller pitch refers to an inclination of the propeller blade surface. The blade angle determines the performance of the propeller. Accordingly, propellers are made to be different in pitch, depending on the type and the purpose of the propellers.

In the past, propellers were made integrally. As a result, various molding tools were used to make the propellers different in pitch, thereby resulting in the high cost of producing the propellers since a different mold had to be used for each type of propeller.

The boat propeller pitch affects the cruising speed, the thrust, and the fuel efficiency of the boat. For this reason, the small boat is provided with a propeller with an appropriate pitch on the basis of the journey data, such as the time of the journey, the carrying load, the fuel remaining in the tank, and the like. Nowadays, there are boat propellers with an adjustable pitch. As a result, the boat operators do not have to purchase a variety of boat propellers different in pitch. However, such conventional boat propellers with the adjustable pitch are complicated in construction and operation and are not cost-effective.

SUMMARY OF THE INVENTION

It is therefore an objective of the claimed invention to provide a simple, cost-effective boat propeller adjustable in pitch in order to solve the above-mentioned problems. Each blade of the boat propeller has an adjustment member connected to the blade with a reinforced connection. During assembly of the boat propeller, the adjustment members can be configured to give the boat propeller varying degrees of pitch.

According to the claimed invention, a boat propeller comprises a hub formed of a first cylindrical member and a second cylindrical member which are detachably joined together, the first cylindrical member comprising a plurality of first slots, and the second cylindrical member comprising: a plurality of second slots corresponding to the first slots for forming a plurality of receiving cavities with the first slots when the first cylindrical member is joined with the second cylindrical member; and a plurality of insertion cavities formed in the second cylindrical member, the number of insertion cavities being equal to the number of receiving cavities, an end of each of the insertion cavities having a plurality of receptacle members. The boat propeller also comprises a plurality of blades equal in number to the number of receiving cavities, each blade comprising: a blade piece portion; an oval-shaped insertion portion connected with an inner end of the blade piece portion, the oval-shaped insertion portion being inserted into one of the receiving cavities when the first cylindrical member and the second cylindrical member are joined together; and an adjustment member formed on the oval-shaped insertion portion, a tip of the adjustment member comprising a positioning member such that the positioning member makes contact with at least one of the receptacle members when the adjustment member is inserted into the corresponding insertion cavity. The positioning member of the adjustment member is selectively matched with one or more of the receptacle members for adjusting a pitch of the blades.

It is an advantage of the claimed invention that the positioning member can be selectively matched with any of the receptacle members for quickly adjusting the pitch of the boat propeller. In addition, propeller can be built inexpensively in high volume since only a few simple parts are required for assembling the adjustable pitch boat propeller.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
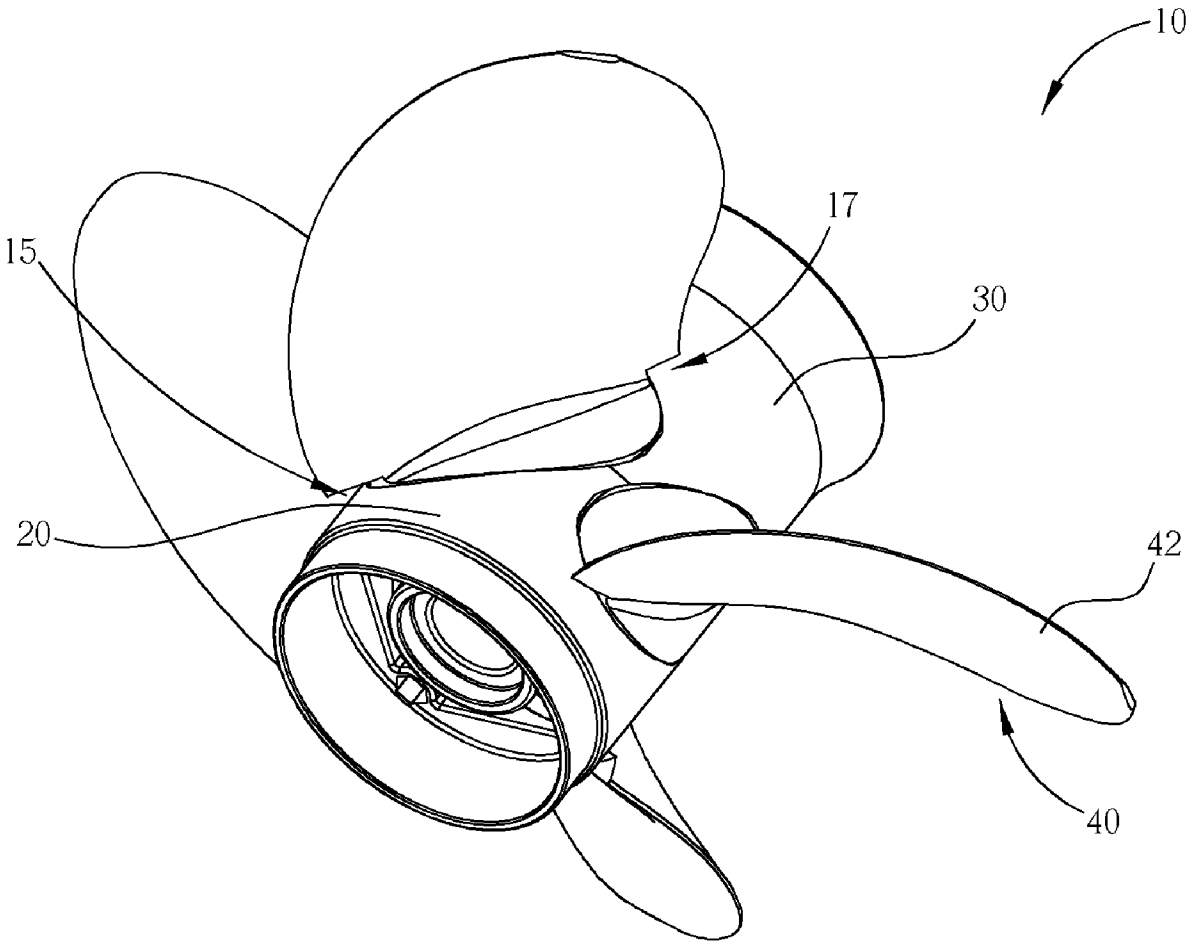
FIG. 1 is a perspective view of a boat propeller according to the present invention.
Figure 2:
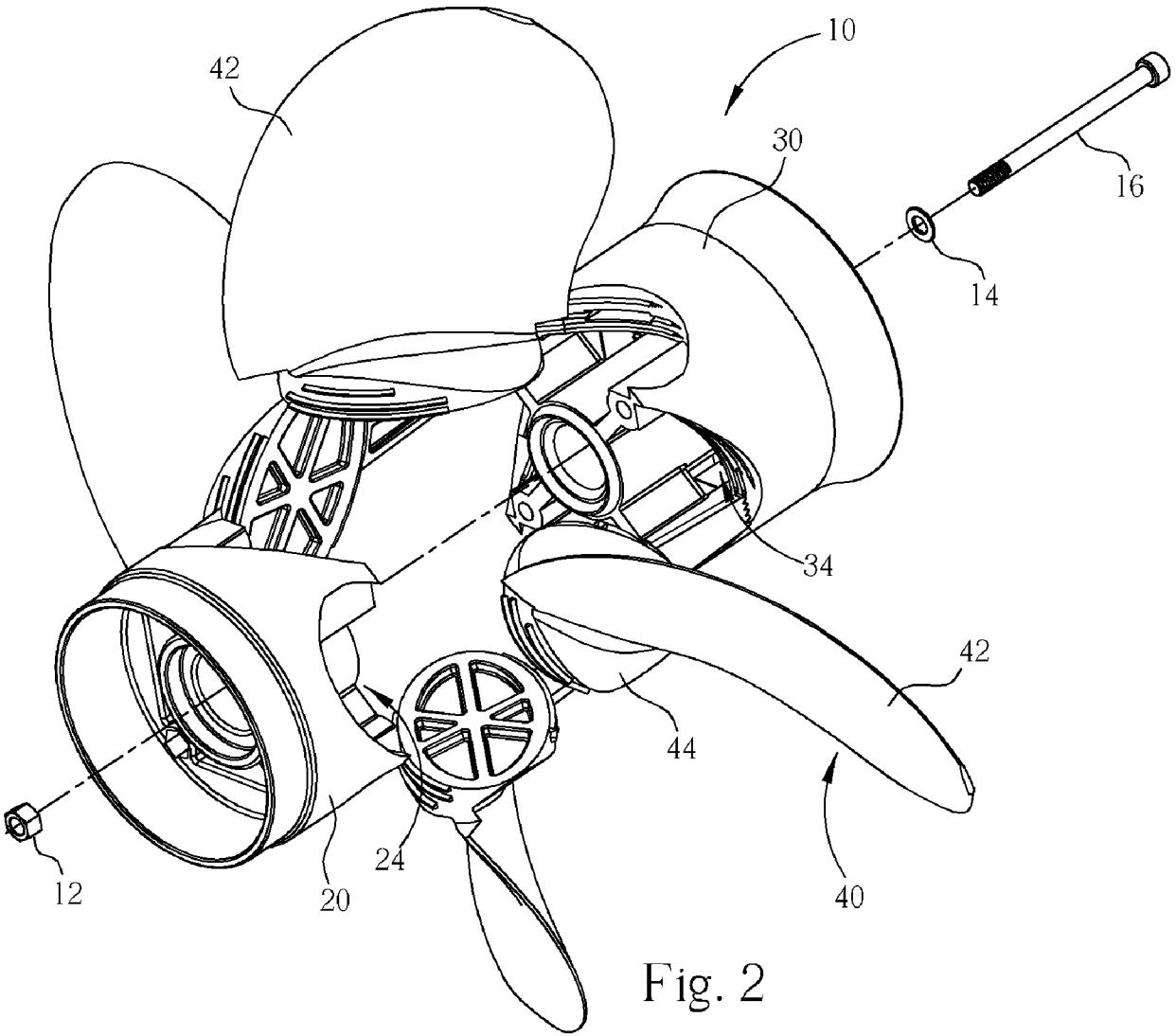
FIG. 2 is an exploded diagram of the boat propeller.
Figure 3:
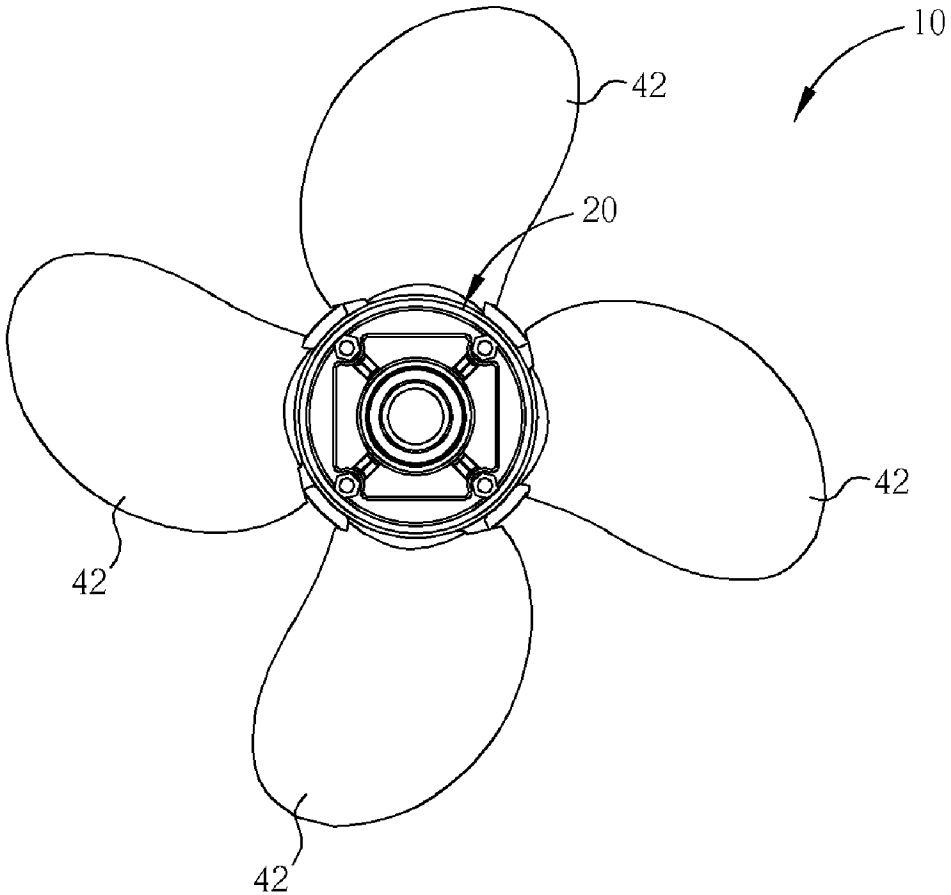
FIG. 3 is a front view of the boat propeller.
Figure 4:
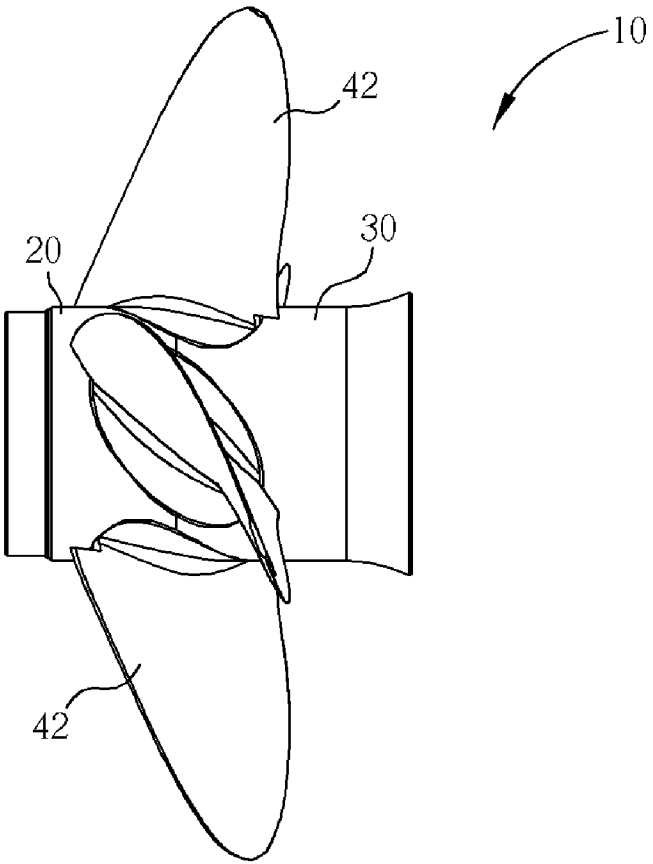
FIG. 4 is a side view of the boat propeller.

Please refer to FIGS. 1-4. FIG. 1 is a perspective view of a boat propeller 10 according to the present invention. FIG. 2 is an exploded diagram of the boat propeller 10, FIG. 3 is a front view of the boat propeller 10, and FIG. 4 is a side view of the boat propeller 10. The boat propeller 10 contains a plurality of blades 40 disposed between a front hub 20 and a rear hub 30 that are detachably joined together. The front hub 20 and the rear hub 30 each preferably have a cylindrical shape. The front hub 20 contains a plurality of front slots 24 on an outer surface of the front hub 20 and the rear hub 30 contains a corresponding number of rear slots 34 on the outer surface of the rear hub 30. When the front hub 20 is joined with the rear hub 30, each front slot 24 and its corresponding rear slot 34 form a receiving cavity that is used for receiving an oval-shaped insertion portion 44 of each blade 40. Although the oval-shaped insertion portions 44, the front slots 24 and the rear slots 34 are shown having rounded shapes, these shapes are merely used as an example, and should not be construed as limiting the scope of the present invention. When the boat propeller 10 is fully assembled, there is a small gap 15 between the blades 40 and the front hub 20 and another small gap 17 between the blades 40 and the rear hub 30. However, the gaps 15, 17 are near the base of the blades 40, and will not affect the water flow field very much. Therefore, the gaps 15, 17 will not decrease the total efficiency of the boat propeller 10.

As shown in FIG. 2, the front hub 20 and the rear hub 30 can be fastened together through a variety of means, such as by using a bolt 16, a washer 14, and a nut 12. As will be explained below, the design of the boat propeller 10 is such that the front hub 20 and the rear hub 30 can be easily disassembled and reassembled for adjusting the pitch of twisted blade piece portions 42 of the blades 40.

Figure 5:
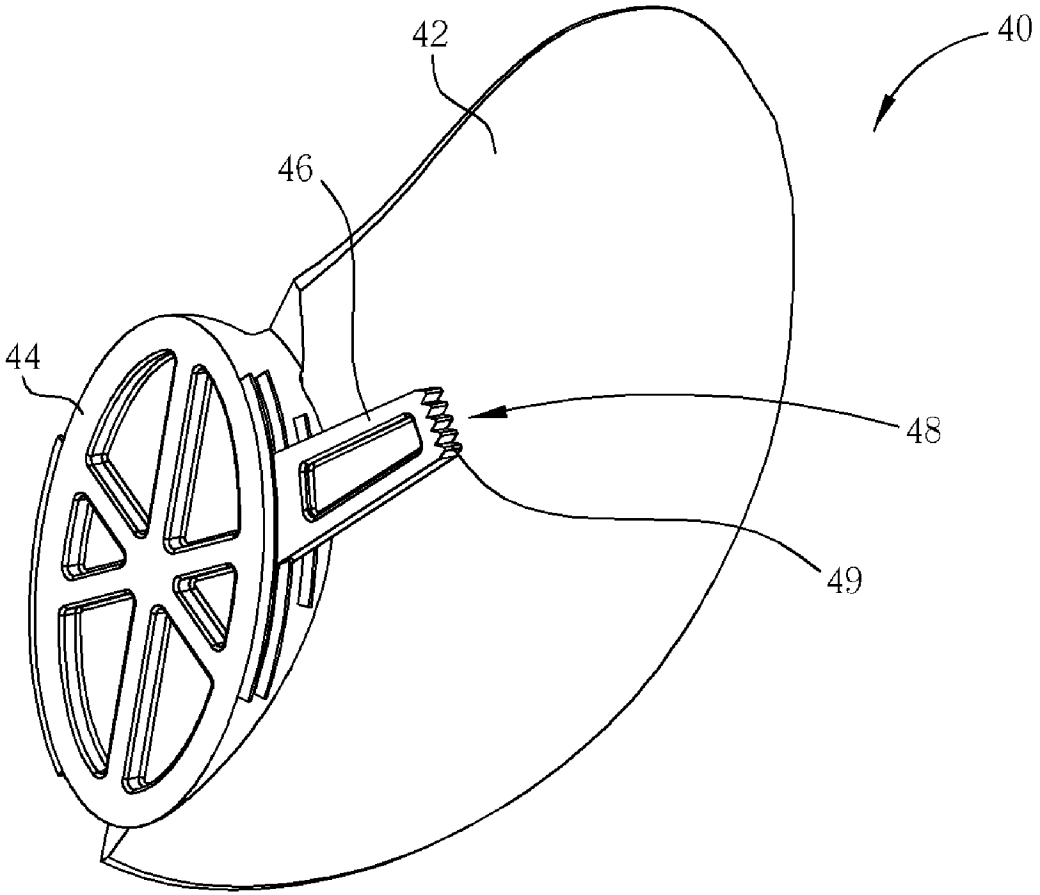
FIG. 5 is a diagram of the blade according to the present invention.

Please refer to FIG. 5. FIG. 5 is a diagram of the blade 40 according to the present invention. For adjusting the pitch of the blade 40, an adjustment member 46 is attached to the oval-shaped insertion portion 44 of the blade 40. The adjustment member 46 is preferably joined to the oval-shaped insertion portion 44 with a reinforced connection, such as a curved joint between the adjustment member 46 and the oval-shaped insertion portion 44. This reinforced joint will prevent the adjustment member 46 from breaking easily. In the preferred embodiment of the present invention, a tip 48 of the adjustment member 46 contains one or more gear teeth 49, but other positioning means can also be used instead of the gear teeth 49.

Figure 6:
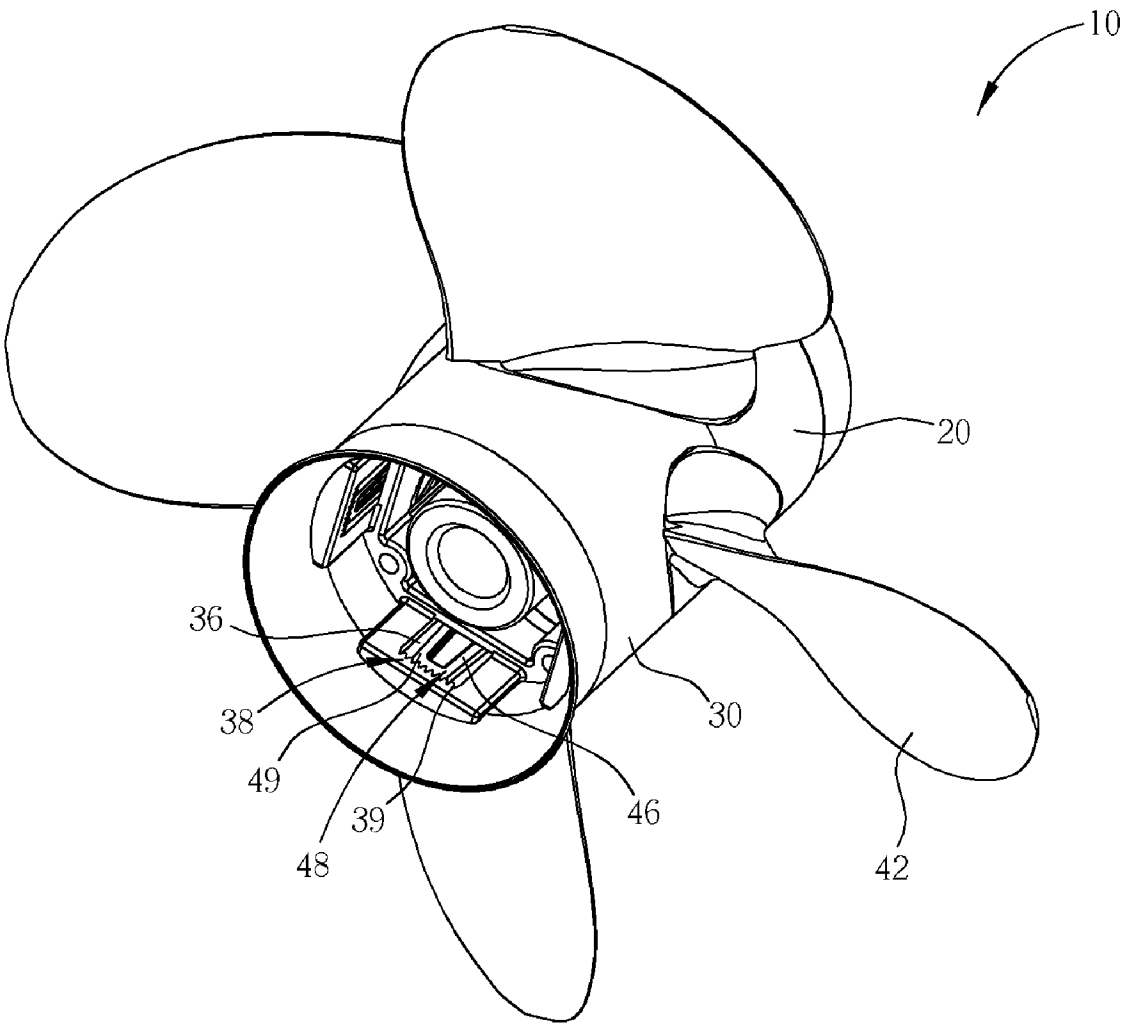
FIG. 6 is a rear view of the assembled boat propeller.

Please refer to FIG. 6. FIG. 6 is a rear view of the assembled boat propeller 10. The rear hub 30 contains a plurality of insertion cavities 36 formed in the respective rear slots 34 for receiving the adjustment members 46 of the blades 40. An end 38 of each insertion cavity 36 contains a plurality of gear receptacles 39 for receiving the gear teeth 49 of the adjustment member 46. As shown in FIG. 6, the gear teeth 49 are shown positioned in a middle section of the gear receptacles 39. In order to adjust a pitch of the blades 40, the position of the adjustment member 46 can be moved within the insertion cavity 36 such that the gear teeth 49 are moved to the left or right of the middle section of the gear receptacles 39. All that needs to be done is to disassemble the front hub 20 from the rear hub 30, adjust the positions of the adjustment members 46 within the corresponding insertion cavities 36, and reassemble the front hub 20 and the rear hub 30.

Figure 7:
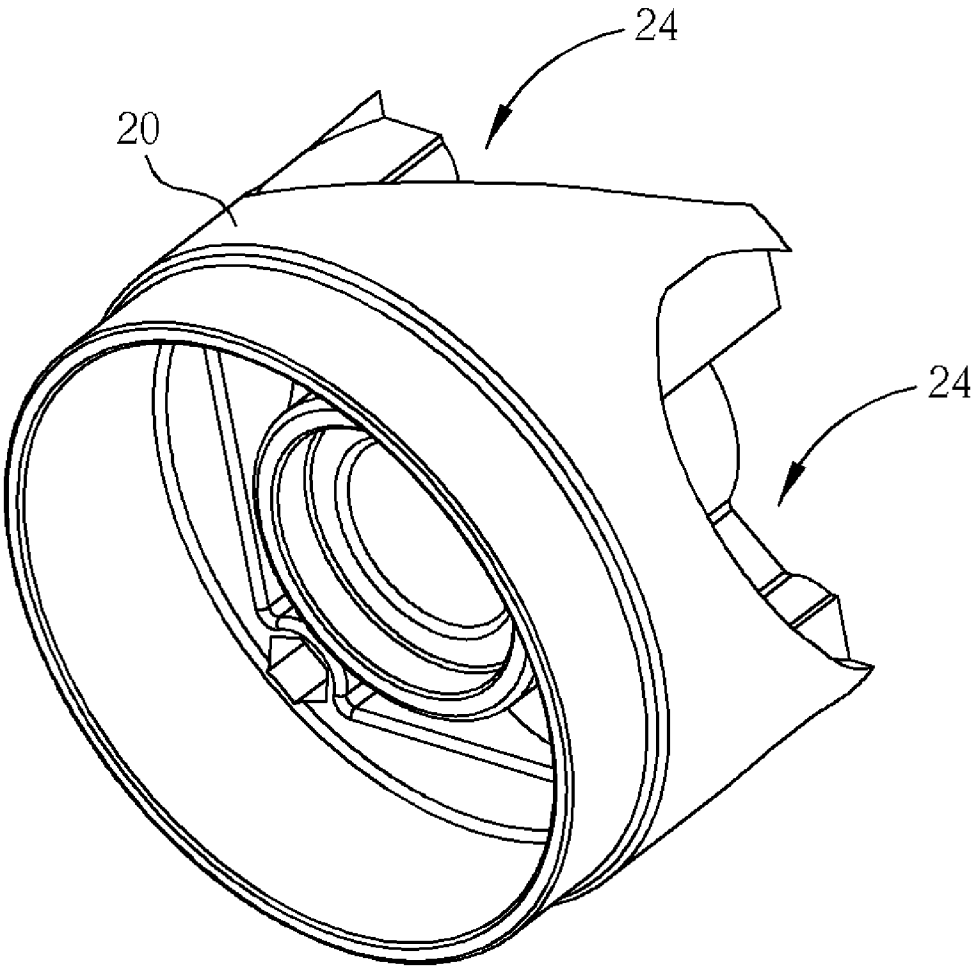
FIGS. 7-8 are front perspective and rear perspective diagrams of the front hub, respectively.
Figure 8:
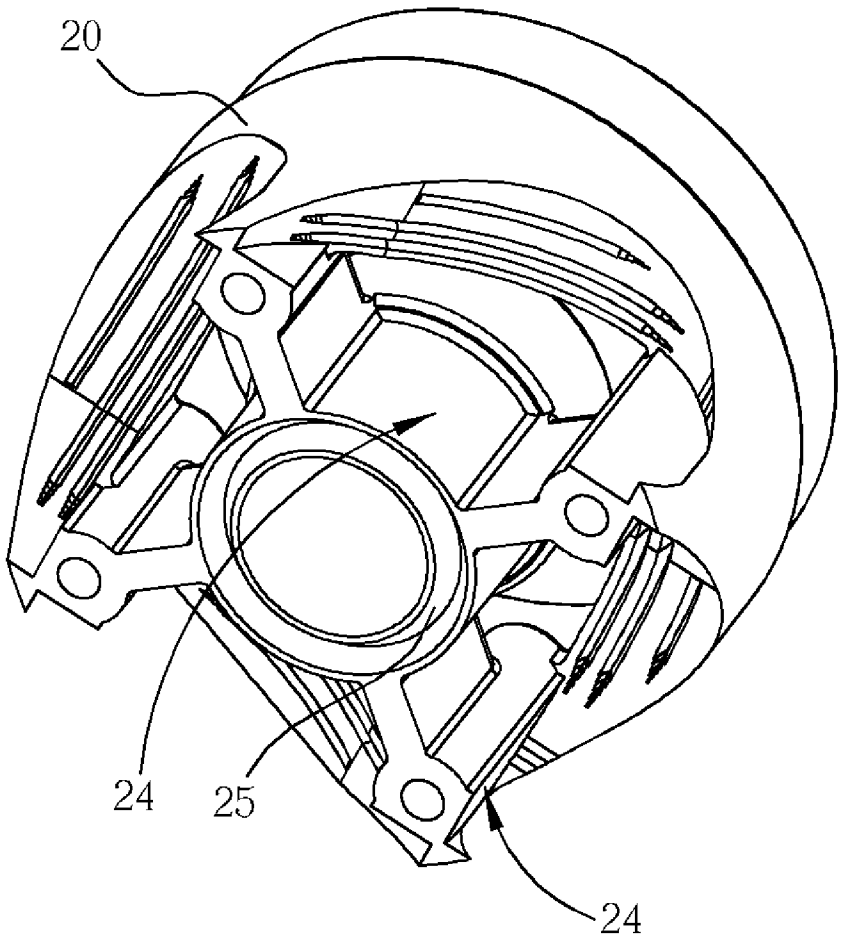

Please refer to FIGS. 7-10. FIGS. 7-8 are front perspective and rear perspective diagrams of the front hub 20, respectively. The front hub 20 also contains an outward protrusion 25 for connecting with the rear hub 30, as will be explained shortly.

Figure 9:
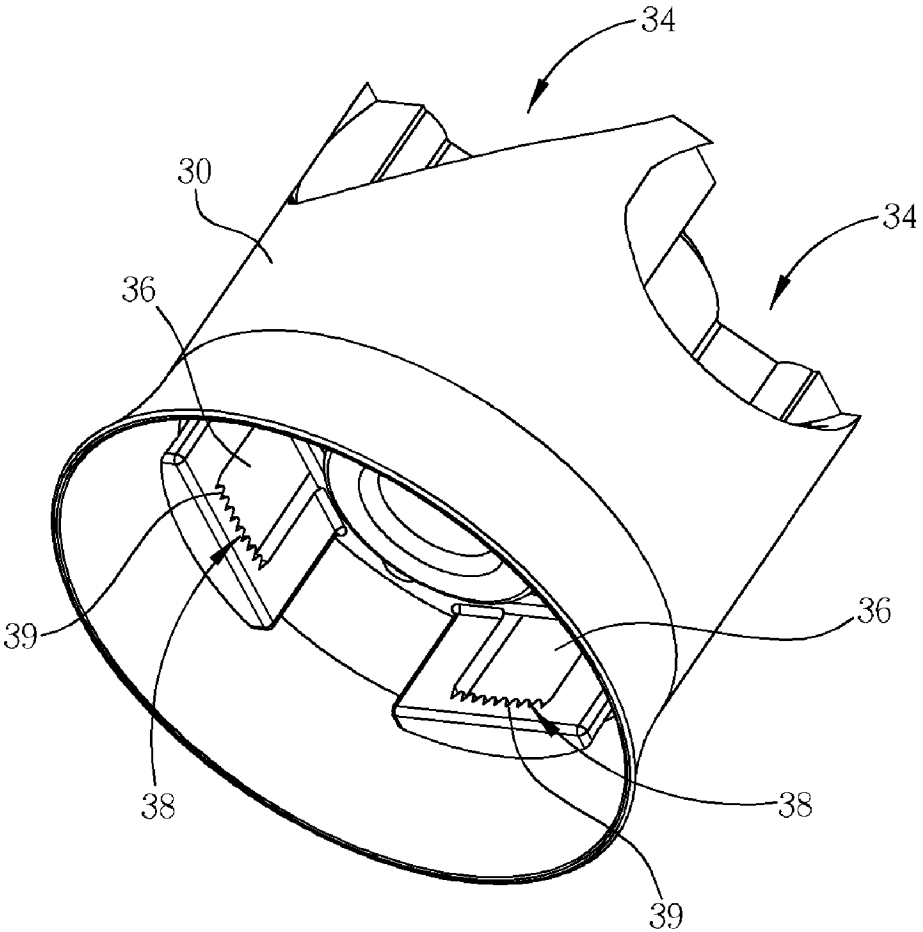
FIGS. 9-10 are front perspective and rear perspective diagrams of the rear hub, respectively.
Figure 10:
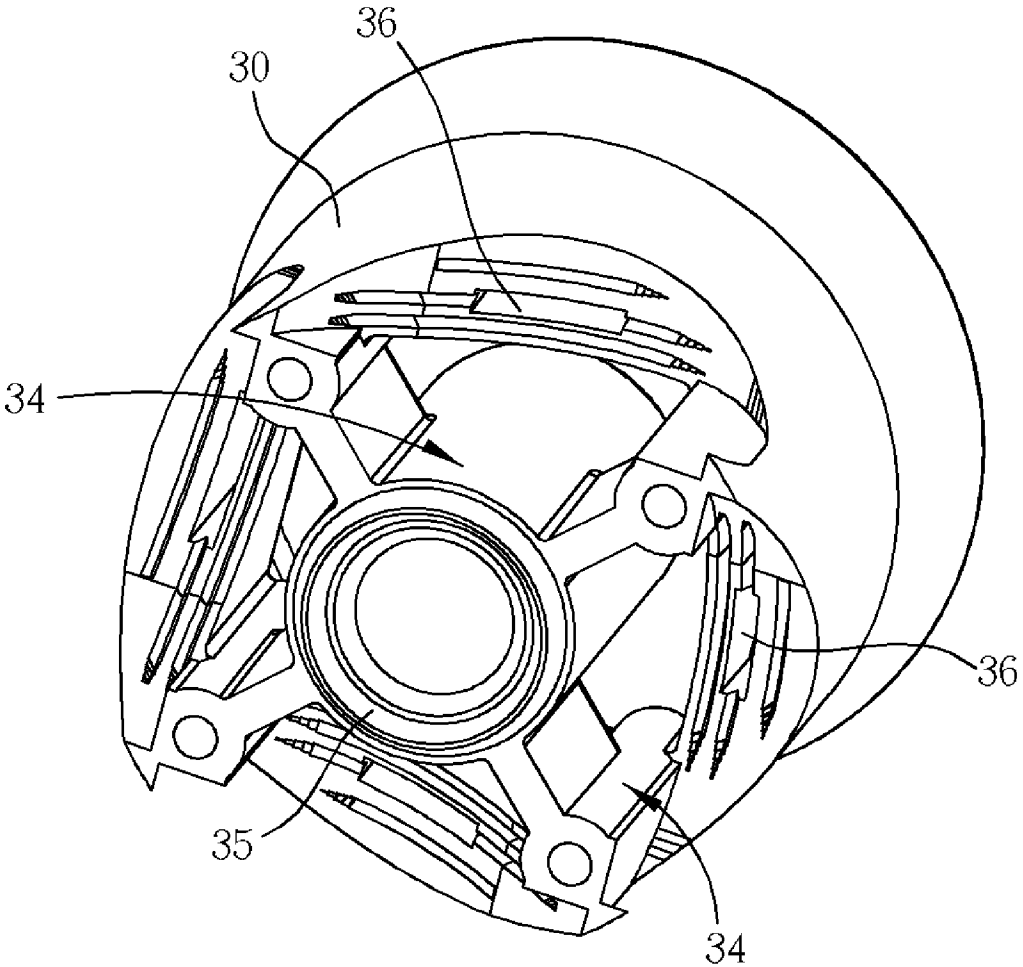

FIGS. 9-10 are front perspective and rear perspective diagrams of the rear hub 30, respectively. The rear hub 30 further comprises an inward hole 35 that complements the outward protrusion 25 of the front hub 20. The outward protrusion 25 and the inward hole 35 are used to tightly join the front hub 20 to the rear hub 30. When assembling the boat propeller 10, it is easiest to first insert the adjustment members 46 of the blades 40 in the corresponding insertion cavities 36 of the rear hub 30. Then, the gear teeth 49 at the tip 48 of each adjustment member 46 can be matched with the appropriate gear receptacles 39 of the corresponding insertion cavity 36 for adjusting the pitch of the blades 40. Next, the front hub 20 can be joined and fastened together with the rear hub 30 and the blades 40, while at the same time ensuring that the outward protrusion 25 is inserted into the inward hole 35, for completing the assembly of the boat propeller 10.

Figure 11:
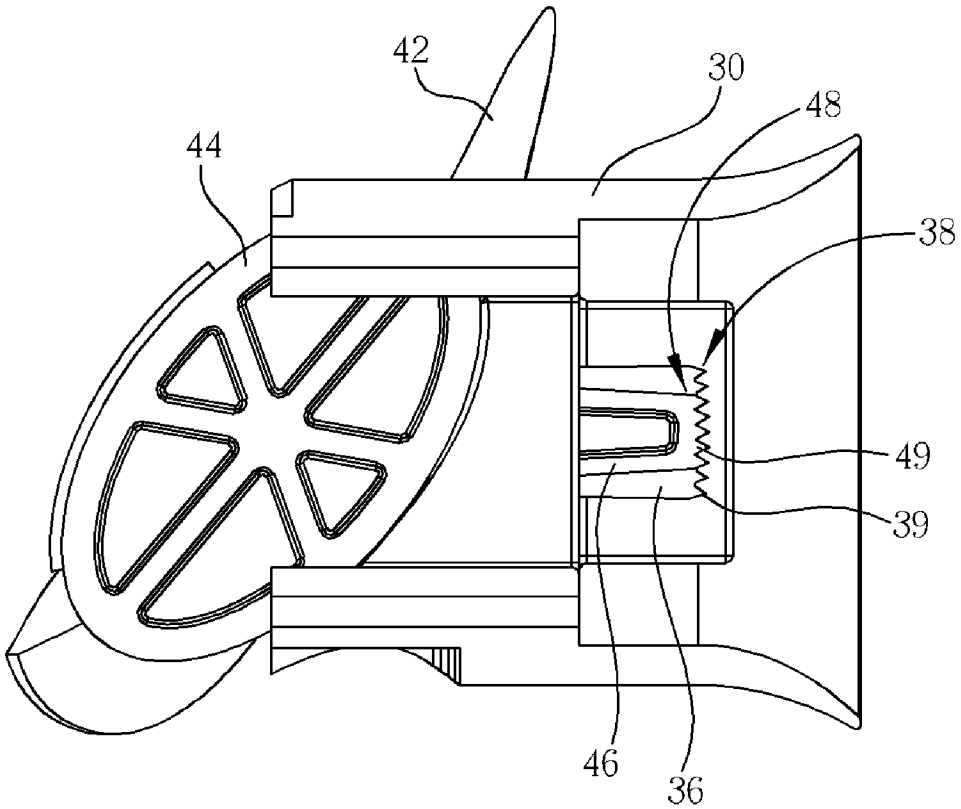
FIG. 11 is a detailed diagram showing the connection between the adjustment member and the insertion cavity of each blade according to the present invention.

Please refer to FIG. 11. FIG. 11 is a detailed diagram showing the connection between the adjustment member 46 and the insertion cavity 36 of each blade 40 according to the present invention. The gear teeth 49 at the tip 48 of the adjustment member 46 fit together with the gear receptacles 39 at the end 38 of the insertion cavity 36. As an example, FIG. 11 illustrates five potential positions for adjusting the pitch of the twisted blade piece portion 42 of the blade 40. The position of the gear teeth 49 can be in the center of the gear receptacles 39 (as shown), can be moved either one or two positions to the left, or can be moved one or two positions to the right. Therefore, this example shows how the pitch of the blade 40 can be adjusted to have one of five different values. Of course, more or less possible positions can be used with the present invention according to the specific purpose and applications of the boat propeller.

In summary, the blades of the present invention contain the adjustment members, which can be selectively positioned in the insertion cavities of the rear hub for adjusting the pitch of the blades. Because of the few parts required for manufacturing the boat propeller of the present invention, the present invention provides a simple and inexpensive adjustable pitch boat propeller.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A boat propeller, comprising:

a hub formed of a first cylindrical member and a second cylindrical member which are detachably joined together, the first cylindrical member comprising:

a plurality of first slots; and the second cylindrical member comprising:

a plurality of second slots corresponding to the first slots for forming a plurality of receiving cavities with the first slots when the first cylindrical member is joined with the second cylindrical member; and a plurality of insertion cavities formed in the second cylindrical member, the number of insertion cavities being equal to the number of receiving cavities, an end of each of the insertion cavities having a plurality of receptacle members; and a plurality of blades equal in number to the number of receiving cavities, each blade comprising:

a blade piece portion;

an oval-shaped insertion portion connected with an inner end of the blade piece portion, the oval-shaped insertion portion being inserted into one of the receiving cavities when the first cylindrical member and the second cylindrical member are joined together; and an adjustment member formed on the oval-shaped insertion portion, a tip of the adjustment member comprising a positioning member such that the positioning member makes contact with at least one of the receptacle members when the adjustment member is inserted into the corresponding insertion cavity;

wherein the positioning member of the adjustment member is selectively matched with one or more of the receptacle members for adjusting a pitch of the blades.

2. The boat propeller of claim 1, wherein the first cylindrical member is a front cylindrical member and the second cylindrical member is a rear cylindrical member.

3. The boat propeller of claim 1, wherein the first slots are formed on an outer surface of the first cylindrical member, the second slots are formed on an outer surface of the second cylindrical member, and the receiving cavities are formed on an outer portion of the hub for receiving the oval-shaped insertion portions of the blades.

4. The boat propeller of claim 1, wherein the receptacle members are gear teeth.

5. The boat propeller of claim 4, wherein the positioning member comprises at least one gear tooth.

6. The boat propeller of claim 1, wherein each insertion cavity is formed in the corresponding second slot for receiving the adjustment member of the blade as the oval-shaped insertion portion of the blade is inserted into the corresponding receiving cavity.

7. The boat propeller of claim 1, wherein the first cylindrical member has an outward protrusion and the second cylindrical member has a corresponding inward hole, and when the first cylindrical member is joined together with the second cylindrical member, the outward protrusion fits into the inward hole for tightly joining the first cylindrical member to the second cylindrical member.

* * * * *